US008733134B2

(12) United States Patent
Han et al.

(10) Patent No.: US 8,733,134 B2
(45) Date of Patent: May 27, 2014

(54) AUXILIARY LAUNDRY TREATING MACHINE AND MULTIPLE TREATING SYSTEM INCLUDING THE SAME

(75) Inventors: Dong Joo Han, Changwon-si (KR); Chul Jin Choi, Changwon-si (KR); Young Bok Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1261 days.

(21) Appl. No.: 12/595,785

(22) PCT Filed: Apr. 11, 2008

(86) PCT No.: PCT/KR2008/002045
§ 371 (c)(1),
(2), (4) Date: Jun. 21, 2010

(87) PCT Pub. No.: WO2008/127027
PCT Pub. Date: Oct. 23, 2008

(65) Prior Publication Data

US 2010/0281929 A1 Nov. 11, 2010

(30) Foreign Application Priority Data

Apr. 13, 2007 (KR) ..... 10-2007-0036462

(51) Int. Cl.
*D06F 29/00* (2006.01)

(52) U.S. Cl.
USPC ..... 68/20

(58) Field of Classification Search
USPC ..... 68/3 R, 19.2, 20, 19.1
See application file for complete search history.

(56) References Cited

U.S. PATENT DOCUMENTS

| | | | | |
|---|---|---|---|---|
| 3,402,477 | A * | 9/1968 | Hubbard | 34/543 |
| 2002/0017117 | A1* | 2/2002 | Sunshine et al. | 68/3 R |
| 2005/0275325 | A1 | 12/2005 | Yang | |
| 2006/0090524 | A1 | 5/2006 | Jeon et al. | |
| 2006/0156765 | A1 | 7/2006 | Sunshine et al. | |
| 2007/0151312 | A1* | 7/2007 | Bruce et al. | 68/3 R |

FOREIGN PATENT DOCUMENTS

| | | | |
|---|---|---|---|
| CN | 1467494 | A | 1/2004 |
| EP | 1 439 258 | A2 | 7/2004 |
| JP | 59-108597 | A | 6/1984 |
| JP | 1-145099 | A | 6/1989 |
| JP | 4-20397 | A | 1/1992 |
| JP | 10-216399 | A | 8/1998 |
| KR | 10-2006-0038796 | A | 5/2006 |
| KR | 10-2006-0111260 | A | 10/2006 |
| KR | 10-0774207 | B1 | 11/2007 |
| KR | 10-0774208 | B1 | 11/2007 |
| WO | WO-2007/024056 | A1 | 3/2007 |

* cited by examiner

*Primary Examiner* — David Cormier
(74) *Attorney, Agent, or Firm* — Birch, Stewart, Kolash & Birch, LLP

(57) ABSTRACT

An auxiliary laundry treating machine that is capable of improving energy efficiency and maximally securing a laundry receiving space and a multiple treating system including the same are disclosed. The auxiliary laundry treating machine includes a machine body mounted at one side of a main laundry treating machine that washes or dries laundry, a container for receiving laundry, the container being configured to be inserted into and withdrawn from the machine body, and an air supply unit mounted in the main laundry treating machine for supplying air into the container. The air supply unit includes a blowing fan for suctioning and blowing air in the main laundry treating machine and a heater for heating the air blown by the blowing fan. Also, the multiple treating system includes a main laundry treating machine for washing or drying laundry and the auxiliary laundry treating machine.

16 Claims, 3 Drawing Sheets

AUXILIARY LAUNDRY TREATING MACHINE AND MULTIPLE TREATING SYSTEM INCLUDING THE SAME

TECHNICAL FIELD

The present invention relates to an auxiliary laundry treating machine and a multiple treating system including the same, and more particularly, to an auxiliary laundry treating machine that is usable with a main laundry treating machine and a multiple treating system including the same.

BACKGROUND ART

Generally, laundry treating machines are machines that are capable of washing and/or drying laundry. Specifically, the respective laundry treating machines perform a washing operation, a drying operation, or a washing-and-drying operation. Recently, there has been increasingly used a laundry treating machine, including a steam generator, that is capable of performing a refreshing operation to remove wrinkles, smells, and static electricity from laundry.

The sizes of the laundry treating machines have been gradually increased to satisfy consumer's demands.

On the other hand, there is a washing machine having no drying function among the laundry treating machines. In this case, it is required for a user to have an additional drying machine, when the user wishes to dry laundry.

Alternatively, it is required for the user to have a washing machine including a drying function.

Also, the sizes of the laundry treating machines having a drying function have been gradually increased, with the result that the large-sized laundry treating machines are used even to dry a relatively small quantity of laundry, and therefore, energy efficiency of the respective laundry treating machines lowers.

DISCLOSURE OF INVENTION

Technical Problem

An object of the present invention devised to solve the problem lies on an auxiliary laundry treating machine that is capable of treating a small amount of laundry without the operation of a relatively large-sized laundry treating machine, thereby achieving convenience of use and improving energy efficiency, and a multiple treating system including the same.

Another object of the present invention devised to solve the problem lies on an auxiliary laundry treating machine that is capable of maximally securing a laundry receiving space and a multiple treating system including the same.

Technical Solution

The object of the present invention can be achieved by providing an auxiliary laundry treating machine including a machine body mounted at one side of a main laundry treating machine that washes or dries laundry, a container for receiving laundry, the container being configured to be inserted into and withdrawn from the machine body, and an air supply unit mounted in the main laundry treating machine for supplying air into the container, wherein the air supply unit includes a blowing fan for suctioning and blowing air in the main laundry treating machine and a heater for heating the air blown by the blowing fan.

In another aspect of the present invention, provided herein is a multiple treating system including a main laundry treating machine for washing or drying laundry and an auxiliary laundry treating machine including a machine body mounted at one side of the main laundry treating machine, a container for receiving laundry, the container being configured to be slidably mounted in the machine body, and an air supply unit mounted in the main laundry treating machine for supplying air into the container, wherein the air supply unit includes a blowing fan for suctioning and blowing air in the main laundry treating machine and a heater for heating the air blown by the blowing fan.

Advantageous Effects

The auxiliary laundry treating machine and the multiple treating system including the same according to the present invention have the effect of drying a small amount of laundry without the operation of a relatively large-sized main laundry treating machine, thereby achieving convenience of use and saving energy.

Also, the air supply unit is not mounted in the auxiliary laundry treating machine but in the main laundry treating machine. Consequently, the auxiliary laundry treating machine and the multiple treating system including the same according to the present invention have the effect of maximally securing a laundry receiving space of the auxiliary laundry treating machine.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
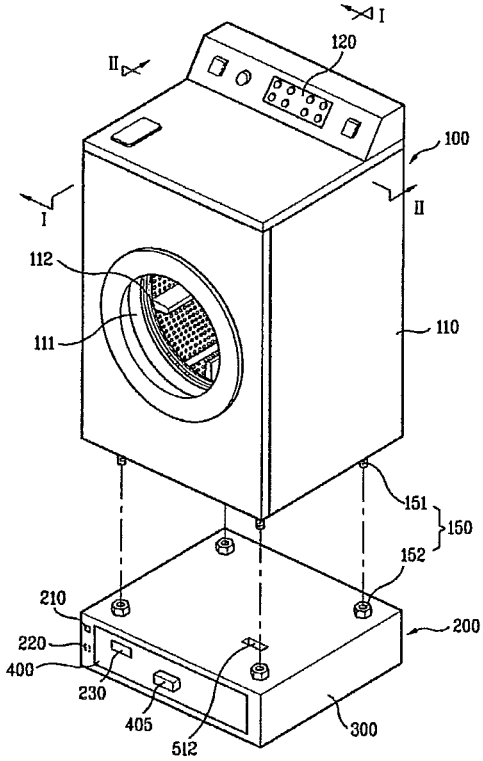
FIG. 1 is a perspective view illustrating a multiple treating system according to an embodiment of the present invention.
Figure 2:
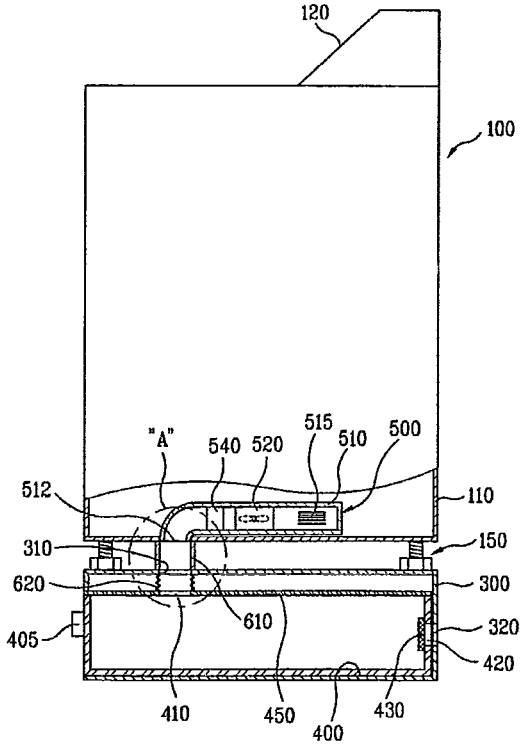
FIG. 2 is a sectional view taken along line I-I of FIG. 1.
Figure 3:
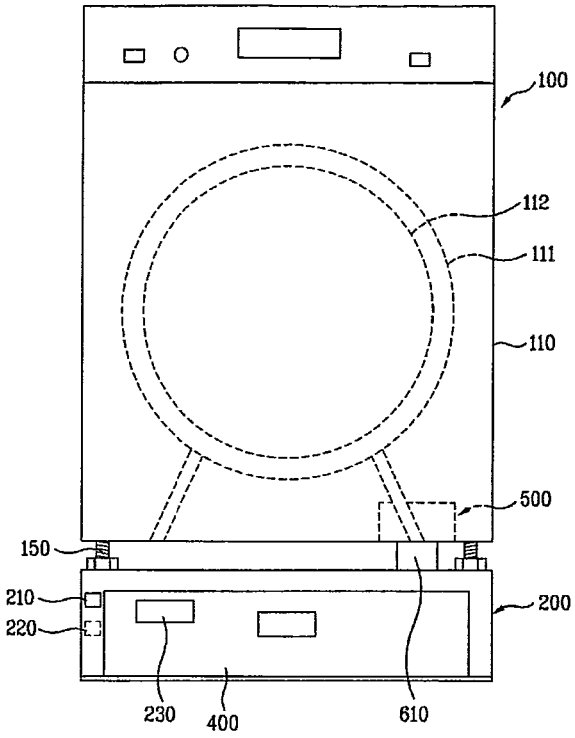
FIG. 3 is a sectional view taken along line II-II of FIG. 1.

FIG. 1 is a perspective view illustrating a multiple treating system according to an embodiment of the present invention, FIG. 2 is a sectional view taken along line I-I of FIG. 1, and FIG. 3 is a sectional view taken along line II-II of FIG. 1.

As shown in FIGS. 1 to 3, a multiple treating system according to an embodiment of the present invention includes a main laundry treating machine 100 and an auxiliary laundry treating machine 200 mounted below the main laundry treating machine 100.

In this embodiment, the auxiliary laundry treating machine 200 is mounted below the main laundry treating machine 100 to serve as a pedestal for the main laundry treating machine 100. However, the auxiliary laundry treating machine 200 is not necessarily mounted below the main laundry treating machine 100. For example, the auxiliary laundry treating machine 200 may be mounted at the top or side of the main laundry treating machine 100.

In this embodiment, a drum type washing machine that washes laundry is illustrated as the main laundry treating machine 100. However, the main laundry treating machine 100 may be a drying machine or a drum type washing machine having a drying function.

The main laundry treating machine 100 includes a cabinet 110 constituting the external appearance of the main laundry treating machine 100, a tub 111 mounted in the cabinet 110 for receiving wash water, and a drum 112 rotatably mounted in the tub 111. Also, a control panel 120 is mounted at the top of the cabinet 110. Although not shown, the control panel 120 may include a power unit for supplying power to the main laundry treating machine 100, a display unit for displaying the operation state of the main laundry treating machine 100, and a controller for controlling a washing operation of the main laundry treating machine 100.

Also, the multiple treating system according to the embodiment of the present invention further includes a coupling unit 150 for stably coupling the auxiliary laundry treating machine 200 to the main laundry treating machine 100. The coupling unit 150 includes a plurality of legs 151 formed at the bottom of the main laundry treating machine 100 for supporting the main laundry treating machine 100 and coupling members 152 formed at the top of the auxiliary laundry treating machine 200 in such a manner that the coupling members 152 are coupled to the respective legs 151.

The auxiliary laundry treating machine 200, mounted below the main laundry treating machine 100, includes a machine body 300 coupled to the cabinet 110 of the main laundry treating machine 100 by means of the coupling unit 150, a container 400 configured to be inserted into and withdrawn from the machine body 300, the container 400 having a laundry receiving space defined therein, and an air supply unit 500 mounted in the cabinet 110 of the main laundry treating machine 100 for supplying air into the container 400.

The machine body 300 is formed in the shape of a rectangular parallelepiped open at the front thereof such that the container 400 can be inserted into and withdrawn from the machine body 300. Also, the machine body 300 is made of a material having a strength sufficient to support the main laundry treating machine 100. In addition, the machine body 300 is provided at the top thereof with a first inlet port 310, through which the air, supplied from the air supply unit 500 mounted in the cabinet 110 of the main laundry treating machine 100, is introduced into the machine body 300.

Also, the machine body 300 is provided at the rear thereof with a first outlet port 320, through which the air, introduced into the machine body 300 through the first inlet port 310, is discharged out of the machine body 300.

The top of the container 400 is open such that laundry can be received into the container 400 through the open top of the container 400. The container 400 moves in a sliding fashion such that the container 400 can be inserted into and withdrawn from the machine body 300. For easy sliding of the container 400, a grip 405 is mounted at the front of the container 400.

Also, the open top of the container 400 is covered with a cover 450, with the result that the container 400 is closed excluding a second inlet port 410 and a second outlet port 420, which will be described hereinafter in detail.

In this embodiment, the cover 450 moves along the open top of the container in a sliding fashion to cover the open top of the container 400. However, the cover 450 may also be hingedly coupled to the upper end of the rear of the container 400 to open and close the top of the container 400.

The cover 450 has a second inlet port 410, through which air is introduced into the container 400. Preferably, the second inlet port 410 is formed at a position corresponding to the first inlet port 310 formed at the top of the machine body 300.

The container 400 is provided at the rear thereof with a second outlet port 420, through which the air, introduced into the container 400, is discharged out of the container 400. The second outlet port 420 is located at a position corresponding to the first outlet port 320 formed at the rear of the machine body 300 such that the air, introduced into the container 400, can be rapidly discharged out of the container 400.

At the second outlet port 420 is also mounted a filter 430 for filtering out foreign matter, such as lint, discharged through the second outlet port 420. Preferably, the filter 430 is a deodorizing filter that is cable of filtering out smells generated from laundry received in the container 400.

The air supply unit 500, which supplies air into the container 400 to dry or deodorize laundry received in the container 400, is mounted in the main laundry treating machine, preferably at the bottom of the cabinet 110.

More specifically, as shown in FIG. 3, the air supply unit 500 is not mounted below the center of the tub 111 but is biased toward one side from the center of the tub 111. As the air supply unit 500 is mounted such that the air supply unit 500 is biased toward one side from the center of the tub 111, it is possible to mount the air supply unit 500 in the existing cabinet 110 without increasing the height of the cabinet 110.

As the air supply unit 500 is not mounted in the auxiliary laundry treating machine 200 but in the main laundry treating machine 100, as described above, it is possible to manufacture the auxiliary laundry treating machine 200 in a compact structure and to maximally secure a laundry receiving space of the container 400.

Figure 4:
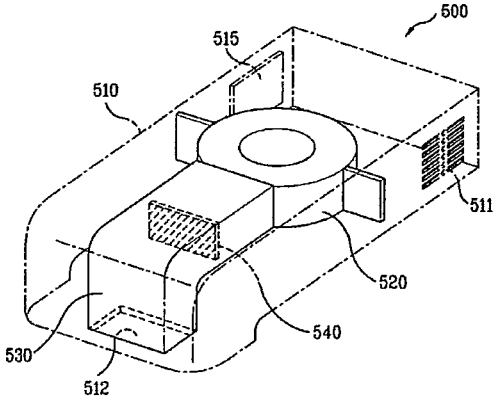
FIG. 4 is a perspective view illustrating an air supply unit of FIG. 2

As shown in FIG. 4, the air supply unit 500, which supplies air to the auxiliary laundry treating machine 200, includes a blowing fan 520 for suctioning and blowing air in the main laundry treating machine 100, a duct 530 for guiding the air, suctioned by the blowing fan 520, to be discharged into the machine body 300 of the auxiliary laundry treating machine 200, and a heater 540 mounted in the duct 530 for heating the air to be discharged to the machine body 300 of the auxiliary laundry treating machine 200.

The outlet of the blowing fan 520 is in tight contact with the inlet of the duct 530. Consequently, all the air discharged from the blowing fan 520 is introduced into the duct 530, and the air introduced into the duct 530 is heated by the heater 540. At one end of the duct 530 is formed a discharge port, through which the heated air is discharged to the container 400.

Meanwhile, the air supply unit 500 preferably further includes a housing 510 for surrounding the blowing fan 520 and the duct 530. The housing 510 extends lengthily in the forward-and-rearward direction of the washing machine. At one end of the housing 510 are formed suction ports 511 for suctioning air. At the other end of the housing 510 is formed a discharge port 512 for discharging air.

The suction ports 511 are formed at opposite sides of the one end of the housing 510 such that a large amount of air can be stationed through the suction ports 511. The discharge port 512 is formed at the bottom of the housing 510 such that the air blown by the blowing fan 520 can be discharged into the auxiliary laundry treating machine 200 through the discharge port 512.

In particular, a filter 515 is mounted at each suction port 511 for preventing foreign matter, such as dust, contained in the air in the main laundry treating machine 100 from being introduced into the container 400. The discharge port 512 constitutes a single discharge port together with the discharge port formed at the duct 530.

The blowing fan 520 is preferably configured to adjust the amount of air to be blown. This is because it is possible to provide an optimum amount of air depending upon the amount of laundry received in the container 400 by changing the rotation speed of the blowing fan 520 depending upon the amount of laundry.

For example, when the amount of laundry received in the container 400 is large, a large amount of air is introduced into the container 400, and the introduced air is discharged within a short time, thereby redoing laundry drying or deodorizing time.

The heater 530 may be configured using various heaters, such as an electric heater and a gas heater. Preferably, the heater 530 is implemented by a small-sized electric heater, in consideration of the characteristics of the auxiliary laundry treating machine 200. In particular, a sheath heater or a positive temperature coefficient (PTC) heater is preferably used as the heater 530. Also, it is preferred to implement the heater 530 using a heater of which the temperature is controllable such that the temperature of air heated by the heater can be changed. Consequently, it is possible to adjust the temperature of air introduced into the container 400 depending upon materials of laundry or the amount of laundry received in the container 400.

The air supply unit 500 is mounted in the main laundry treating machine 100, particularly at the bottom of the cabinet 110. The bottom of the cabinet 110 and the top of the auxiliary laundry treating machine 200 are spaced a predetermined distance from each other by the coupling unit 150. For this reason, the discharge port 512 of the air supply unit 500 and the inlet port 310 of the machine body 300 communicate with each other through a communication member 610.

Figure 5:
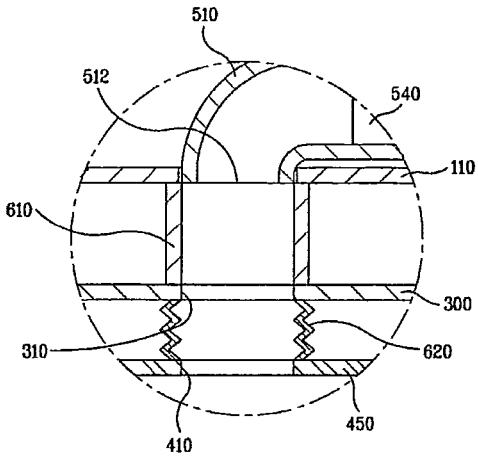
FIG. 5 is an enlarged view illustrating part A of FIG. 2.

As shown in FIG. 5, the upper end of the communication member 610 is fixed to the bottom of the main laundry treating machine 100, and the lower end of the communication member 610 comes into tight contact with the top of the auxiliary laundry treating machine 200 when the main laundry treating machine 100 and the auxiliary laundry treating machine 200 are coupled to each other by means of the coupling unit 150. Of course, the lower end of the communication member 610 is fixed to the top of the auxiliary laundry treating machine 200, and the upper end of the communication member 610 comes into tight contact with the bottom of the main laundry treating machine 100 when the main laundry treating machine 100 and the auxiliary laundry treating machine 200 are coupled to each other by means of the coupling unit 150.

At this time, it is preferred to configure the communication member 610, such that the length of the communication member 610 is greater than the distance between the main laundry treating machine 100 and the auxiliary laundry treating machine 200, to introduce all the air, discharged from the air supply unit 500, into the machine body 300 without the leakage of the air. Also, the communication member 610 is preferably made of a material exhibiting high elasticity and tight contactability, such as rubber.

To introduce the air, introduced through the first inlet port 310 formed at the top of the machine body 300, into the container, a guide tube 620 is mounted between the first inlet port 310 and the second inlet port 410 such that the first inlet port 310 and the second inlet port 410 communicate with each other through the guide tube 20.

The upper end of the guide tube 620 is fixed to the machine body 300 while surrounding the first inlet port 310, and the lower end of the guide tube 620 is supported by the top of the cover 450, when the container 400 is fully received in the machine body 300, such that the lower end of the guide tube 620 communicates with the second inlet port 410. Meanwhile, the guide tube 620 is preferably implemented by a flexible bellows tube. As the flexible bellows tube is used as the guide tube 620, the damage to the guide tube 620 is prevented, when the container 400 slides in the machine body 300, and, at the same time, the guide tube 620 having elasticity comes into tight contact with the cover 450, when the container 400 is fully inserted into the machine body 300, thereby preventing the leakage of air from a gap defined between the first inlet port 310 and the second inlet port 410.

Meanwhile, the auxiliary laundry treating machine 200 may include a power unit 210 for supplying power to the auxiliary laundry treating machine 200, a controller 220 for controlling the operation of the air supply unit 500, and a display unit 230 for displaying the operation state of the auxiliary laundry treating machine 200.

The power unit 210, the controller 220, and the display unit 230 may be provided at the control panel 120 of the main laundry treating machine 100. Alternatively, the power unit 210, the controller 220, and the display unit 230 may be provided independently at the front of the auxiliary laundry treating machine 200. In particular, when the controller 220 is provided at the control panel 120 of the main laundry treating machine 100, the controller 220 can control both the main laundry treating machine 100 and the auxiliary laundry treating machine 200. On the other hand, when the controller 220 is provided independently at the auxiliary laundry treating machine 200, the controller 220 can control the air supply unit 500 independently from the controller of the main laundry treating machine 100.

In the auxiliary laundry treating machine 200 may be mounted a weight sensor (not shown) for measuring the amount of laundry received in the container 400 and a laundry sensor (not shown) for sensing kinds of laundry received in the container 400.

The controller 220 may control the operation of the air supply unit 500 based on the amount of laundry sensed by the weight sensor or the kinds of laundry sensed by the laundry sensor. In particular, the controller 220 preferably controls the rotation speed of the blowing fan 520, mounted in the air supply unit 500, and the temperature of the heater 540, mounted in the air supply unit 500.

For example, when the amount of laundry received in the container 400 is large, the controller 220 controls the blowing fan 520 to be rotated at high speed and the heater 540 such that the temperature of the heater 540 is raised, whereby a large amount of laundry can be dried within a short time. On the other hand, when the amount of laundry received in the container 400 is small, and, in particular, delicate laundry is received in the container 400, the controller 220 controls the blowing fan 520 to be rotated at low speed and the heater 540 such that the temperature of the heater 540 is lowered, whereby the damage to the laundry is prevented.

Figure 6:
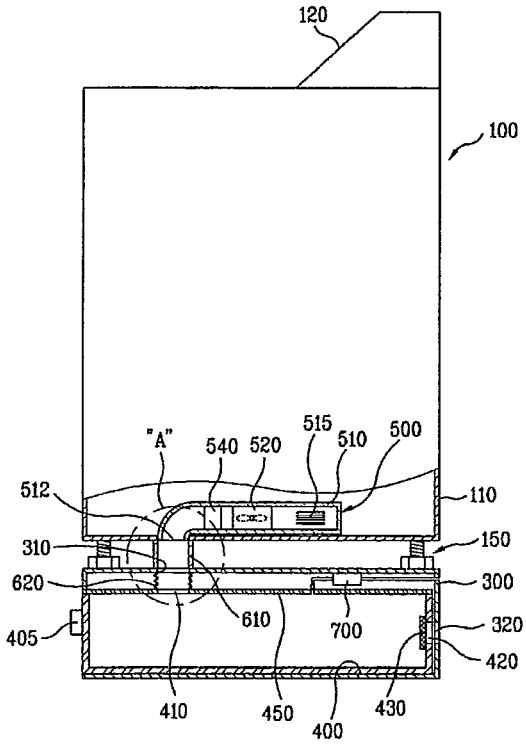
FIG. 6 is a sectional view of the multiple treating system including a steam generator.

Meanwhile, as shown in FIG. 6, the auxiliary laundry treating machine 200 may further include a steam generator 700 for generating steam to perform sterilization or wrinkles removal. Alternatively, it is possible to supply steam into the auxiliary laundry treating machine 200 using a steam generator mounted in the main laundry treating machine 100.

Hereinafter, the operation of the multiple treating system according to the present invention will be described.

A user washes and spin-dries laundry using the main laundry treating machine 100, and then puts a small amount of laundry to be dried in the container 400. When the user operates the air supply unit 500, while the laundry is placed in the container 400, the blowing fan 520 is rotated to blow air from the suction ports 511 to the discharge port 512 of the housing 510.

While the air is blown by the blowing fan 520, the air is heated by the heater 530. The heated air is introduced into the container 400 through the second inlet port 410. The hot and dry air, introduced into the container 400, takes moisture away from the laundry received in the container 400, and is then discharged outside through the second outlet port 420 and the first outlet port 320. In this way, the laundry received in the container is dried or deodorized.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The multiple treating system according to the present invention is capable of drying or deodorizing a small amount of laundry using the auxiliary laundry treating machine without the operation of the main laundry treating machine, thereby saving energy.

Also, the air supply unit is not mounted in the auxiliary laundry treating machine but in the main laundry treating machine. Consequently, the nultiple treating system according to the present invention is capable of maximally securing an inner space of the auxiliary laundry treating machine.

The invention claimed is:

1. An auxiliary laundry treating machine comprising:

a machine body mounted at one side of a main laundry treating machine that washes or dries laundry;

a container for receiving laundry, the container being configured to be inserted into and withdrawn from the machine body;

an air supply unit mounted in the main laundry treating machine for supplying air into the container, the air supply unit comprising:

a blowing fan for suctioning and blowing air in the main laundry treating machine;

a heater for heating the air blown by the blowing fan; and a duct for guiding the air, suctioned by the blowing fan, to be discharged into the machine body, the duct being provided at an end thereof with a discharge port;

a first inlet port in the machine body, through which the air supplied from the air supply unit is introduced into the machine body;

a communication member for allowing the discharge port and the first inlet port to communicate with each other to prevent leakage of the air discharged through the discharge port;

a cover for covering an open top of the container, the cover having a second inlet port formed at a position corresponding to the first inlet port; and a guide tube for allowing the first inlet port and the second inlet port to communicate with each other, the guide tube being made of a flexible material.

2. The auxiliary laundry treating machine according to claim 1, wherein the air supply unit further includes a housing for surrounding the blowing fan and the duct, and wherein the housing is provided with suction ports for suctioning air.

3. The auxiliary laundry treating machine according to claim 2, wherein the air supply unit further includes filters mounted at the respective suction ports for preventing foreign matter contained in air to be suctioned into the air supply unit.

4. The auxiliary laundry treating machine according to claim 1, wherein the machine body has a first outlet port, through which the air, introduced into the machine body through the first inlet port, is discharged out of the machine body.

5. The auxiliary laundry treating machine according to claim 4, wherein the container includes a second outlet port formed at a position corresponding to the first outlet port for allowing the air, introduced into the container, to be discharged out of the container therethrough, and a filter mounted at the second outlet port.

6. The auxiliary laundry treating machine according to claim 1, further comprising:

a controller for controlling the operation of the air supply unit;

a display unit for displaying the operation state of the auxiliary laundry treating machine; and a weight sensor for measuring the amount of laundry received in the container.

7. The auxiliary laundry treating machine according to claim 6, wherein the controller controls the rotation speed of the blowing fan and the temperature of the heater based on the amount of laundry measured by the weight sensor.

8. The auxiliary laundry treating machine according to claim 1, wherein the air supply unit is mounted at the inner bottom of the main laundry treating machine, and the auxiliary laundry treating machine is mounted below the main laundry treating machine.

9. The auxiliary laundry treating machine according to claim 8, wherein the air supply unit is biased toward one side from the middle of the main laundry treating machine.

10. A multiple treating system comprising:

a main laundry treating machine for washing or drying laundry; and an auxiliary laundry treating machine including:

a machine body mounted at one side of the main laundry treating machine;

a container for receiving laundry, the container being configured to be slidably mounted in the machine body;

an air supply unit mounted in the main laundry treating machine for supplying air into the container, the air supply unit including:

a blowing fan for suctioning and blowing air in the main laundry treating machine;

a heater for heating the air blown by the blowing fan; and a duct for guiding the air, suctioned by the blowing fan, to be discharged into the machine body, the duct being provided at an end thereof with a discharge port;

a first inlet port in the machine body, through which the air supplied from the air supply unit, is introduced into the machine body;

a communication member for allowing the discharge port and the first inlet port to communicate with each other to prevent leakage of the air discharged through the discharge port; and a cover for covering an open top of the container, the cover including:

a second inlet port formed at a position corresponding to the first inlet port; and a guide tube for allowing the first inlet port and the second inlet port to communicate with each other, the guide tube being made of a flexible material.

11. The multiple treating system according to claim 10, further comprising:

a coupling unit for coupling the main laundry treating machine and the auxiliary laundry treating machine to each other.

12. The multiple treating system according to claim 10, further comprising:

a power unit for supplying power to the auxiliary laundry treating machine; and a display unit for displaying the operation state of the auxiliary laundry treating machine, wherein the power unit and the display unit are mounted at the main laundry treating machine.

13. The multiple treating system according to claim 10, further comprising:

a power unit for supplying power to the auxiliary laundry treating machine; and a display unit for displaying the operation state of the auxiliary laundry treating machine, wherein the power unit and the display unit are mounted at the auxiliary laundry treating machine.

14. The multiple treating system according to claim 10, wherein the auxiliary laundry treating machine is mounted below the main laundry treating machine for serving as a pedestal for the main laundry treating machine.

15. The multiple treating system according to claim 10, wherein the auxiliary laundry treating machine includes a steam generator for generating steam, and the auxiliary laundry treating machine is supplied with steam from the steam generator.

16. The multiple treating system according to claim 10, further comprising:

a steam generator for generating steam to be supplied into the container.

* * * * *